US011557419B2

(12) United States Patent
Nayak

(10) Patent No.: US 11,557,419 B2
(45) Date of Patent: Jan. 17, 2023

(54) THERMAL MANAGEMENT OF INDUCTOR ON A COLD PLATE

(71) Applicant: Hamilton Sundstrand Corporation, Charlotte, NC (US)

(72) Inventor: Hebri Vijayendra Nayak, Rockford, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 408 days.

(21) Appl. No.: 16/909,459

(22) Filed: Jun. 23, 2020

(65) Prior Publication Data

US 2021/0398732 A1 Dec. 23, 2021

(51) Int. Cl.

| | |
|---|---|
| ***H01F 27/32*** | (2006.01) |
| ***H01F 27/10*** | (2006.01) |
| ***H01F 27/02*** | (2006.01) |
| ***H01F 27/26*** | (2006.01) |
| ***H01F 27/30*** | (2006.01) |

(52) U.S. Cl.

CPC ..... *H01F 27/10* (2013.01); *H01F 27/025* (2013.01); *H01F 27/266* (2013.01); *H01F 27/306* (2013.01)

(58) Field of Classification Search

CPC ..... H01F 27/10; H01F 27/025; H01F 27/266; H01F 27/306; H01F 27/22; H01F 37/00

See application file for complete search history.

(56) References Cited

U.S. PATENT DOCUMENTS

| | | | | |
|---|---|---|---|---|
| 9,066,453 | B2 | 6/2015 | Wagner et al. | |
| 9,786,425 | B2 | 10/2017 | Sakaguchi et al. | |
| 10,083,788 | B2 | 9/2018 | Ko | |
| 2015/0170817 | A1 | 6/2015 | Yamashima et al. | |
| 2018/0166208 | A1* | 6/2018 | Ikeda | H01F 30/10 |
| 2018/0272889 | A1 | 9/2018 | Nakamura et al. | |
| 2019/0272944 | A1* | 9/2019 | Takagi | H01F 3/10 |
| 2020/0135378 | A1 | 4/2020 | Joshi et al. | |

FOREIGN PATENT DOCUMENTS

| | | | |
|---|---|---|---|
| JP | 2004319618 | A | 11/2004 |
| JP | 2008182151 | A | 8/2008 |
| JP | 2009147041 | A | 7/2009 |
| JP | 2009188033 | A | 8/2009 |
| JP | 2015090912 | A | 5/2015 |
| WO | 2006016554 | A1 | 2/2006 |

OTHER PUBLICATIONS

Extended European Search Report for EP Application No. 21181207.8, dated Nov. 25, 2021, pp. 1-9.

* cited by examiner

*Primary Examiner* — Muhammad S Islam
(74) *Attorney, Agent, or Firm* — Cantor Colburn LLP

(57) ABSTRACT

A cold plate and a method of manufacturing a cold plate involve a first side with a first surface, and a second side, opposite the first side, with a second surface opposite the first surface. The cold plate includes a flow channel formed between the first side and the second side, and a cavity integrally machined into the first surface of the first side. The cavity seats an inductor and is defined by an outer wall and a base with thicker sections and thinner sections such that even the thicker sections of the base are thinner than a thickness of the first surface.

20 Claims, 6 Drawing Sheets

THERMAL MANAGEMENT OF INDUCTOR ON A COLD PLATE

BACKGROUND

Exemplary embodiments pertain to the art of thermal management and, in particular, to thermal management of an inductor on a cold plate.

A liquid cold plate is a platform for mounting power electronic components. The cold plate provides localized cooling to the components by transferring heat from the components mounted on one or both surfaces to the liquid flowing within. One of the components that may be placed on a cold plate is an inductor. An inductor is a passive two-terminal electrical component that stores energy in a magnetic field when current flows through it. Generally, in inductor includes an insulated wire wound around a core as a coil.

BRIEF DESCRIPTION

In one embodiment, a cold plate includes a first side with a first surface, and a second side, opposite the first side, with a second surface opposite the first surface. The cold plate also includes a flow channel formed between the first side and the second side, and a cavity integrally machined into the first surface of the first side. The cavity seats an inductor and is defined by an outer wall and a base with thicker sections and thinner sections such that even the thicker sections of the base are thinner than a thickness of the first surface.

Additionally or alternatively, in this or other embodiments, the cold plate also includes an inlet to channel coolant into the flow channel.

Additionally or alternatively, in this or other embodiments, the cold plate also includes an outlet to channel the coolant out of the flow channel.

Additionally or alternatively, in this or other embodiments, a thickness of the first side is greater than a thickness of the second side.

Additionally or alternatively, in this or other embodiments, the cavity includes first portions, second portions, and a center plate.

Additionally or alternatively, in this or other embodiments, the first portions have the base with the thicker sections and each of the thicker sections supports a core of the inductor.

Additionally or alternatively, in this or other embodiments, the outer wall corresponding with each of the first portions is curved.

Additionally or alternatively, in this or other embodiments, the first portions are on opposite ends of the center plate such that the outer wall corresponding with each of the first portions is perpendicular to the center plate.

Additionally or alternatively, in this or other embodiments, the second portions have the base with the thinner sections and each of the thinner sections supports windings of the inductor.

Additionally or alternatively, in this or other embodiments, the outer wall corresponding with each of the second portions is straight.

Additionally or alternatively, in this or other embodiments, the second portions are on opposite sides of the center plate such that the outer wall corresponding with each of the second portions is parallel with the center plate.

Additionally or alternatively, in this or other embodiments, the cold plate also includes one or more additional ones of the cavity to seat one or more additional ones of the inductor.

Additionally or alternatively, in this or other embodiments, the outer wall of at least one of the one or more additional ones of the cavity is part of the outer wall of the cavity.

In another embodiment, a method of fabricating a cold plate includes machining a flow channel between a first side with a first surface and a second side, opposite the first side, with a second surface opposite the first surface. The method also includes machining a cavity into the first surface of the first side. The cavity seats an inductor and is defined by an outer wall and a base with thicker sections and thinner sections such that even the thicker sections of the base are thinner than a thickness of the first surface.

Additionally or alternatively, in this or other embodiments, the method also includes forming an inlet to channel coolant into the flow channel, forming an outlet to channel the coolant out of the flow channel, and positioning the flow channel such that a thickness of the first side is greater than a thickness of the second side.

Additionally or alternatively, in this or other embodiments, the machining the cavity includes machining first portions, second portions, and a center plate.

Additionally or alternatively, in this or other embodiments, the machining the first portions includes forming the first portions with the base with the thicker sections. Each of the thicker sections supports a core of the inductor. The machining the second portions includes forming the second portions with the base with the thinner sections. Each of the thinner sections supports windings of the inductor.

Additionally or alternatively, in this or other embodiments, the method also includes machining the outer wall of each of the first portions to be curved and machining the outer wall of each of the second portions to be straight.

Additionally or alternatively, in this or other embodiments, the machining the cavity includes machining the first portions to be on opposite ends of the center plate such that the outer wall of each of the first portions is perpendicular to the center plate, and machining the second portions to be on opposite sides of the center plate such that the outer wall of each of the second portions is parallel to the center plate.

Additionally or alternatively, in this or other embodiments, the method also includes machining one or more additional ones of the cavity to seat one or more additional ones of the inductor. The machining includes the outer wall of at least one of the one or more additional ones of the cavity being part of the outer wall of the cavity.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As previously noted, a cold plate can support and cool electronic components. Embodiments of the systems and methods detailed herein relate to thermal management of an inductor on a cold plate. Specifically, a cavity is machined as an integral part of the cold plate to accommodate the inductor. As also detailed, more than one cavity may be machined to accommodate more than one inductor on the cold plate. The base of the cavity transfers heat from the inductor to a coolant flowing within the body of the cold plate in a flow channel.

Figure 1:
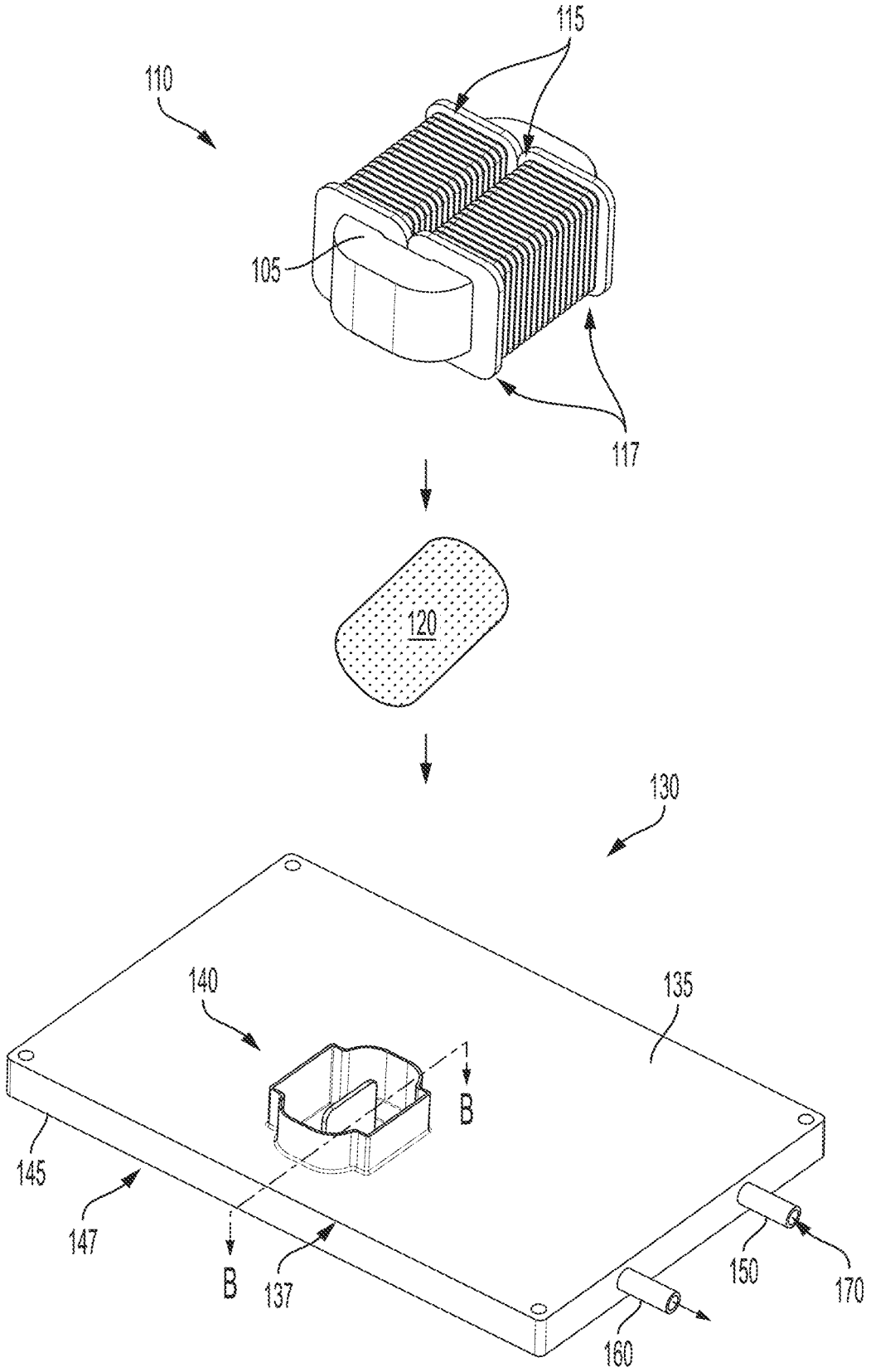
FIG. 1 is an exploded view of a cold plate used for thermal management of an inductor according to one or more embodiments

FIG. 1 is an exploded view of a cold plate 130 used for thermal management of an inductor 110 according to one or more embodiments. The exploded view shows encapsulant 120, referred to also as potting material, and an inductor 110 above the cold plate 130. The encapsulant 120 is thermally conductive but electrically insulating. Thus, the encapsulant 120 encapsulates the inductor 110 and electrically separates the inductor 110 from a cavity 140 of the cold plate 130 while conducting heat from the inductor 110 to the cavity 140. The inductor 110 shown in FIG. 1 is a bobbin wound inductor. In contrast to a toroidal inductor, for example, which includes coils wound directly onto a toroidal core, the windings 115 are pre-wound onto a bobbin 117 and then assembled on a core 105, as shown. The core 105 may be a laminated or taped wound silicon steel alloy, nick-iron alloy, cobalt alloy, or ferrite, for example. The two sets of windings 115 may be copper. The cavity 140 of the cold plate 130 is machined within a surface 135 of a first side 137 for seating the inductor 110. The inductor 110 dissipates heat that is removed according to one or more embodiments in order to maintain the temperature of the inductor 110 below a predefined limit.

The cavity 140 of the cold plate 130 that seats the inductor 110 is further detailed with reference to FIG. 2. The cold plate 130 has a second surface 145, opposite the surface 135, on a second side 147. As previously noted, components could be attached to both the surface 135 and second surface 145 of the cold plate 130. According to exemplary embodiments, the thickness of the first side 137 is greater than the thickness of the second side 147 to accommodate the cavity 140, and components are only disposed on the surface 135. Thus, the exemplary cold plate 130 may be referred to as a one-sided.

An inlet 150 facilitates an inflow of coolant 170 through a flow channel 610 (FIG. 6) within the cold plate 130. The flow channel 610 may be formed as a pipe with fins for additional heat transfer. The flow channel 610 within the cold plate 130 may be formed in a pattern to allow the coolant 170 to absorb heat from different areas of the surface 135 as it moves from the inlet 150 to the outlet 160. That is, heat from the components on the surface 135, or both surfaces 135, 145, is conducted into the coolant 170, which carries the heat out via the outlet 160. Exemplary coolants 170 include ethylene glycol with water (EGW), propylene glycol with water (PGW), and polyalphaolefin (PAO). The cross-section indicated through B-B in shown in FIG. 6.

Figure 2:
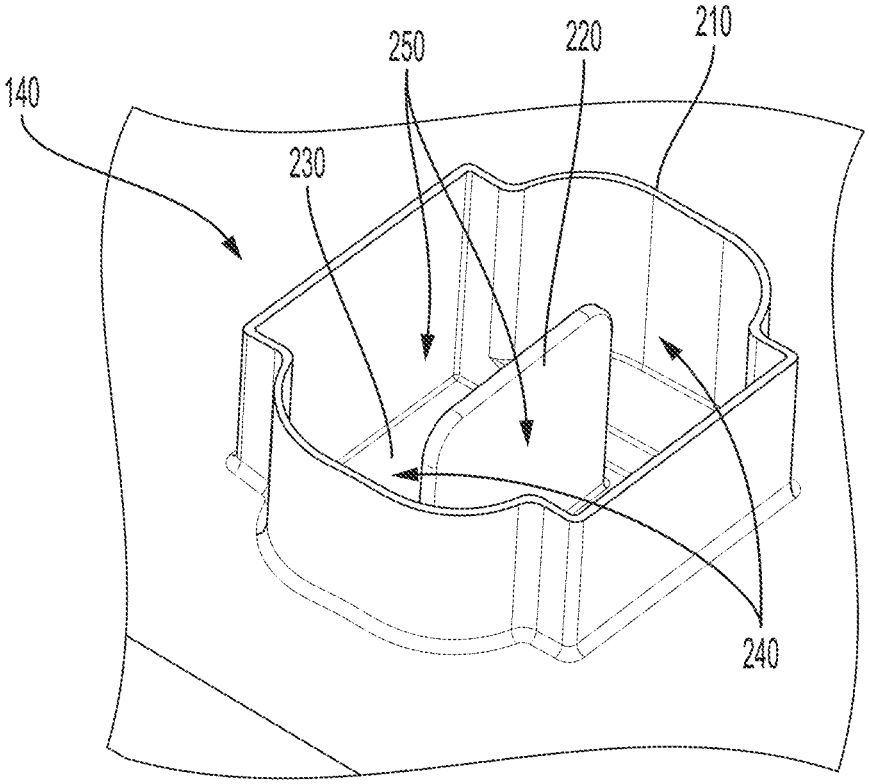
FIG. 2 shows aspects of the cavity used to perform thermal management of the inductor on a cold plate according to one or more embodiments.
Figure 5:
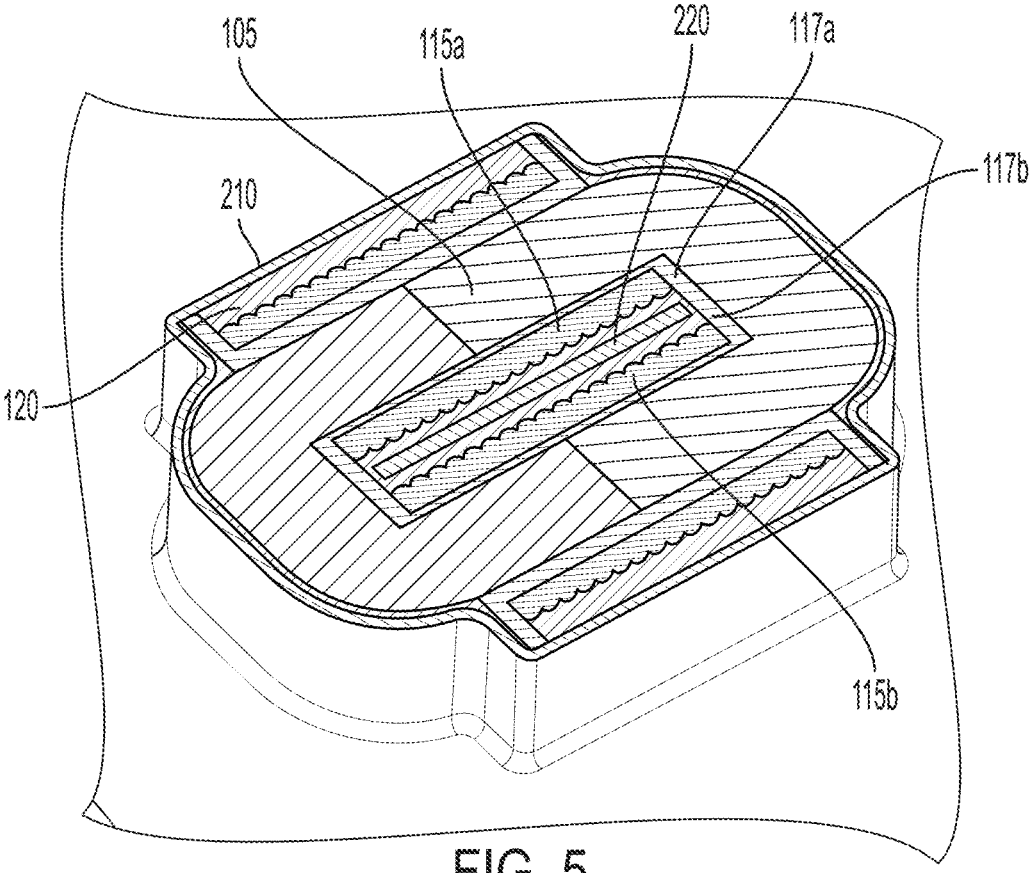
FIG. 5 is a cross-sectional view A-A of an inductor in a cavity that performs thermal management according to one or more embodiments.

FIG. 2 shows aspects of the cavity 140 used to perform thermal management of the inductor 110 on a cold plate 130 according to one or more embodiments. As previously noted, the cavity 140 is machined as an integral part of the cold plate 130. The cold plate 130 and, thus, the cavity 140 are aluminum or copper, for example. The cavity 140 is defined by an outer wall 210 and includes a center plate 220. The center plate 220 does not extend from one side of the outer wall 210 to accommodate the core 105 of the inductor 110 in the cavity 140 as shown in FIG. 5, for example.

The center plate 220 defines first or core portions 240 of the cavity on either end of the center plate 220. The center plate 220 also defines second or winding portions 250 on either side of the center plate 220. The core portions 240 of the cavity 140, which are perpendicular to the center plate 220, support the parts of the core 105 of the inductor 110 that do not include the bobbins 117 and windings 115. The outer wall 210 corresponding with the core portions 240 is curved. The winding portions 250 of the cavity 140, which are parallel to the center plate 220, support the bobbins 117 and windings 115 of the inductor 110. The outer wall 210 corresponding with the winding portions 250 is straight.

The floor or base 230 of the cavity 140 ultimately conducts the heat dissipated by the inductor 110, the heat source, to the coolant 170, the heat sink. The base 230 has a different thickness in the core portions 240 than in the winding portions 250, as discussed with reference to FIG. 7. The heat conduction through the base 230 is further discussed with reference to FIGS. 8 and 9. It should be understood that other components, additional to the inductor 110, may be mounted on the surface 135 of the cold plate 130. Additionally, another one or more cavities 140 to seat another one or more inductors 110 may also be integrated into the surface 135.

Figure 3:
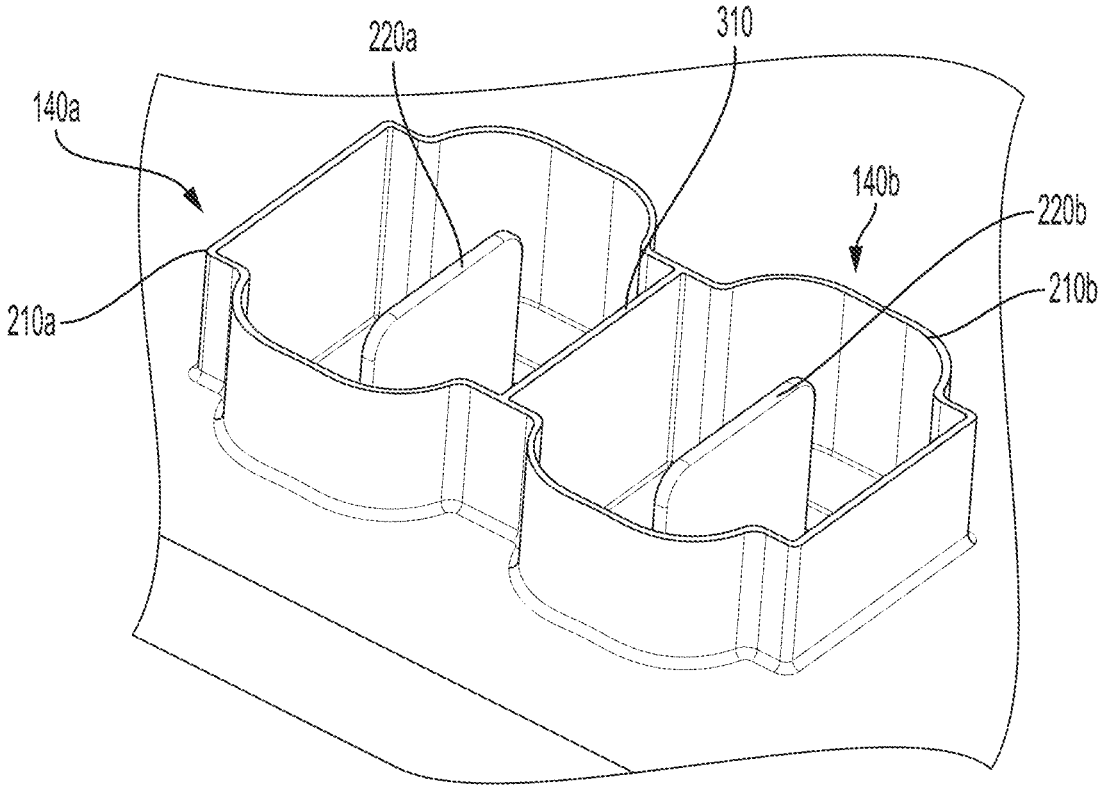
FIG. 3 shows an example of multiple cavities to perform thermal management according to one or more embodiments.

FIG. 3 shows an example of multiple cavities 140 to perform thermal management according to one or more embodiments. Two cavities 140*a* and 140*b* (generally referred to as 140) to accommodate two inductors 110 are shown in FIG. 3. While two cavities 140 are shown in the exemplary case, the number of cavities 140 and corresponding inductors 110 on the cold plate 130 is based on heat dissipation. That is, a particular number of inductors 110 and other components are placed on the surface 135 in consideration of the heat that they dissipate and the cooling capacity of the cold plate 130. The overall cooling capacity of the cold plate 130 is based on several factors including the size and thickness of the surface 135 and the temperature of the coolant 170. As FIG. 3 indicates, each cavity 140 includes a corresponding outer wall 210*a*, 210*b* (generally referred to as 210) and center plate 220*a*, 220*b* (generally referred to as 220). The two cavities 140*a*, 140*b* have a shared wall 310 that is part of both the outer wall 210*a* and the outer wall 210*b*.

Figure 4:
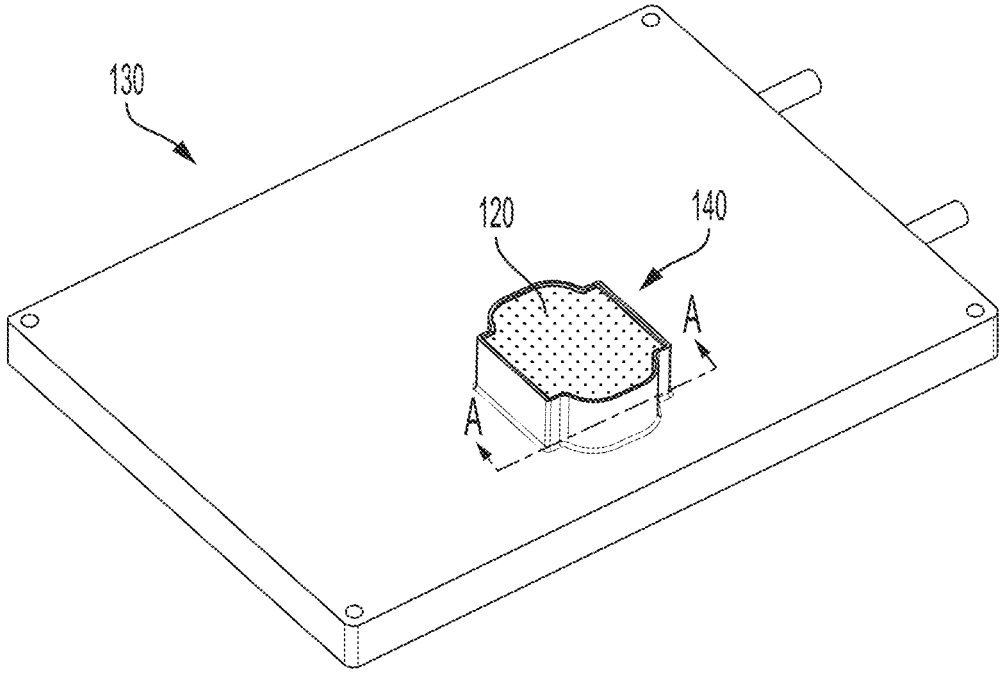
FIG. 4 shows a cold plate that provides thermal management of an inductor seated in the cavity according to one or more embodiments.

FIG. 4 shows a cold plate 130 that provides thermal management of an inductor 110 seated in the cavity 140 according to one or more embodiments. As FIG. 4 indicates, only the encapsulant 120 is visible after the inductor 110 is fully installed in the cavity 140. The encapsulant 120 surrounds the inductor 110 such that no portion of the inductor 110 contacts the cavity 140. This is illustrated in FIG. 5 with a cross-section across A-A.

FIG. 5 is a cross-sectional view A-A of an inductor 110 in a cavity 140 that performs thermal management according to one or more embodiments. As FIG. 4 indicates, the cross-section A-A is taken across the top of the cavity 140 that has the inductor 110 within. Specifically, a top layer of encapsulant 120, windings 115*a*, 115*b* (generally referred to as 115), and bobbins 117*a*, 117*b* (generally referred to as 117) is removed exposing the core 105. As FIG. 5 indicates, encapsulant 120 separates each of the windings 115 and bobbins 117 from the center plate 220. The encapsulant 120 also separates the windings 115, the bobbins 117, and the core 105 from the outer wall 210.

Figure 6:
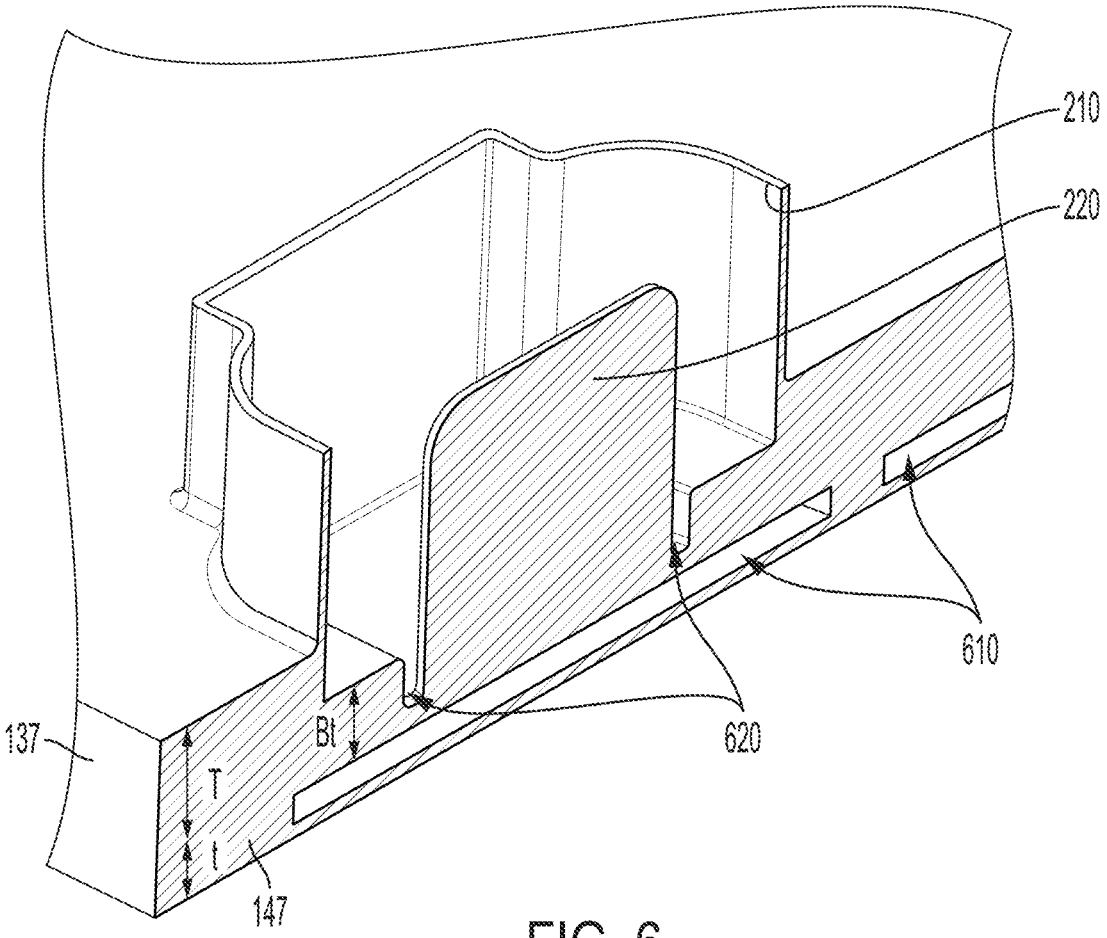
FIG. 6 is a cross-sectional view B-B of a cavity that performs thermal management according to one or more embodiments.

FIG. 6 is a cross-sectional view B-B of a cavity 140 that performs thermal management according to one or more embodiments. As FIG. 1 indicates, the cross-section B-B is taken through the cavity 140 to expose the center plate 220 and the flow channel 610 between the first side 137 and second side 147. The cross-sectional view indicates that the thickness T of the first side 137 of the cold plate 130 that includes the cavity 140 is greater than the thickness t of the second side 147 of the cold plate 130. Sections of the flow channel 610 are visible within the cold plate 130.

As previously noted, the cavity 140 is machined to be an integral part of the cold plate 130. Thus, the outer wall 210 and center plate 220 are machined from the material of the cold plate 130. As a result, thermal interface resistances are eliminated between different aspects of the cavity 140. The absence of thermal interface resistance maximizes heat dissipation from the source (i.e., the inductor 110). As previously noted, the base 230 of the cavity 140 ultimately conducts the heat from the cavity 140 to the heat sink, the coolant 170. The thickness Bt of even the thickest part of this base 230 is minimized, with consideration to structural integrity, to maximize heat transfer from the base 230 to the coolant 170 flowing through the flow channel 610. The base 230 actually includes two thicknesses. This is indicated in FIG. 7.

Figure 7:
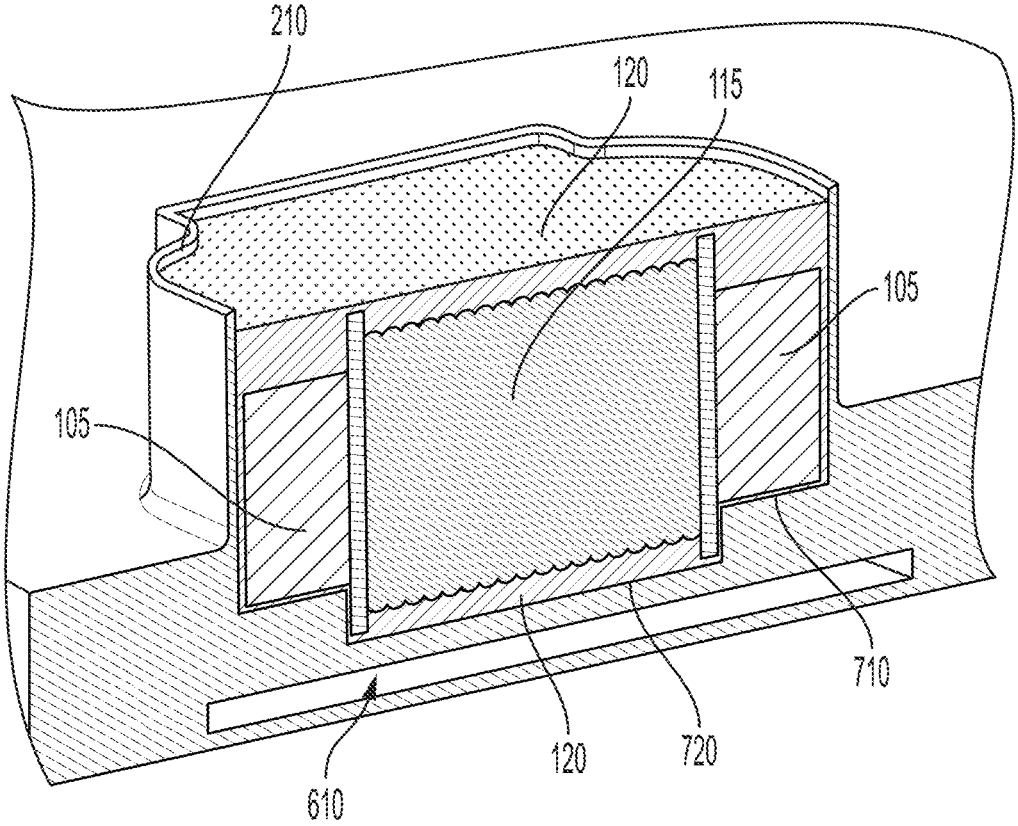
FIG. 7 is a cross-sectional view detailing aspects of the base of the cavity that performs thermal management according to one or more embodiments.

FIG. 7 is a cross-sectional view detailing aspects of the base 230 of the cavity 140 that performs thermal management according to one or more embodiments. The center plate 220 is removed from the view shown in FIG. 7 and the inductor 110 is shown in the cavity 140. This view clarifies that the base 230 of the cavity 140 includes a thicker portion 710 that supports the core 105 of the inductor 110 and also includes a thinner portion 720 that supports the bobbins 117 and windings 115 of the inductor 110. The thicker portions 710 are on opposite ends of the cavity 140 and are perpendicular to the center plate 220 on either end of the center plate 220. The thicker portions 710 correspond with the core portions 240 of the cavity 140 indicated in FIG. 2. The thinner portions 720 of the base 230 correspond with the winding portions 250 of the cavity 140 indicated in FIG. 2. The view of FIG. 7 indicates that the encapsulant 120 that conducts heat from the inductor 110 to the cavity 140 is above, below, and on every side of the inductor 110.

Figure 8:
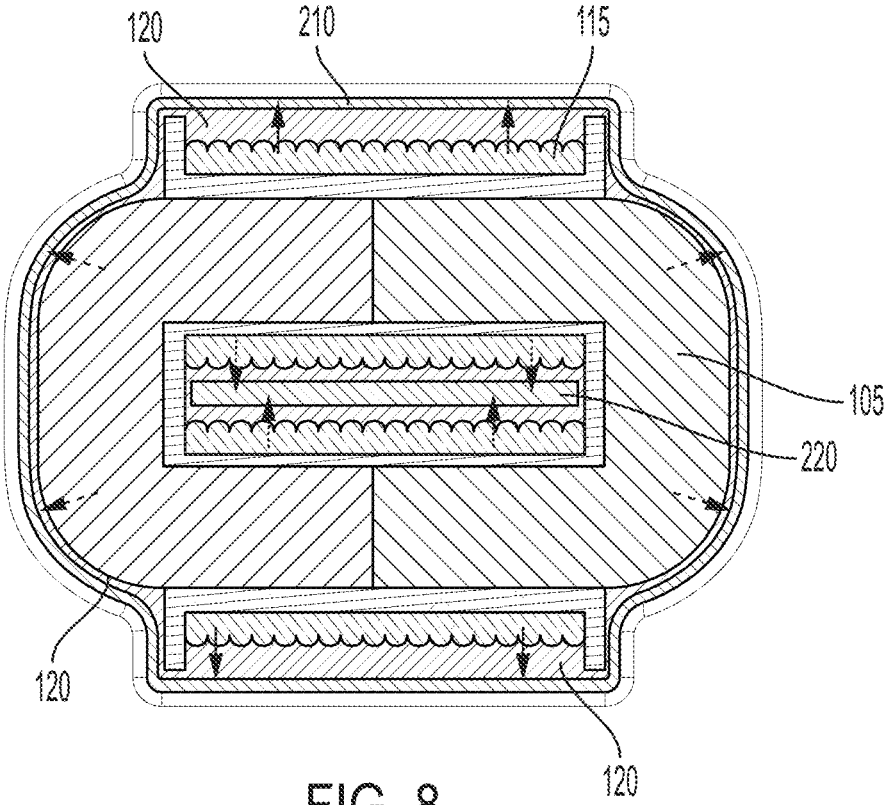
FIG. 8 shows heat flow from the inductor into the cavity according to one or more embodiments.

FIG. 8 shows heat flow from the inductor 110 into the cavity 140 according to one or more embodiments. The cross-sectional view across B-B as shown in FIG. 5 is shown in FIG. 8. As such, the top layer of encapsulant 120, windings 115, and bobbins 117 have been removed. The encapsulant 120 surrounding the inductor 110 on all sides is shown. As the arrows indicate, heat flows into the heat conducting encapsulant 120 from the core 105 and windings 115. This heat flow is both inward into the center plate 220 via encapsulant 120 and outward into the outer wall 210 via encapsulant 120. As previously noted, one or both of the portions of the outer wall 210 that are parallel to the center plate 220 may be shared walls 310 when two or more cavities 140 are part of the cold plate 130.

Figure 9:
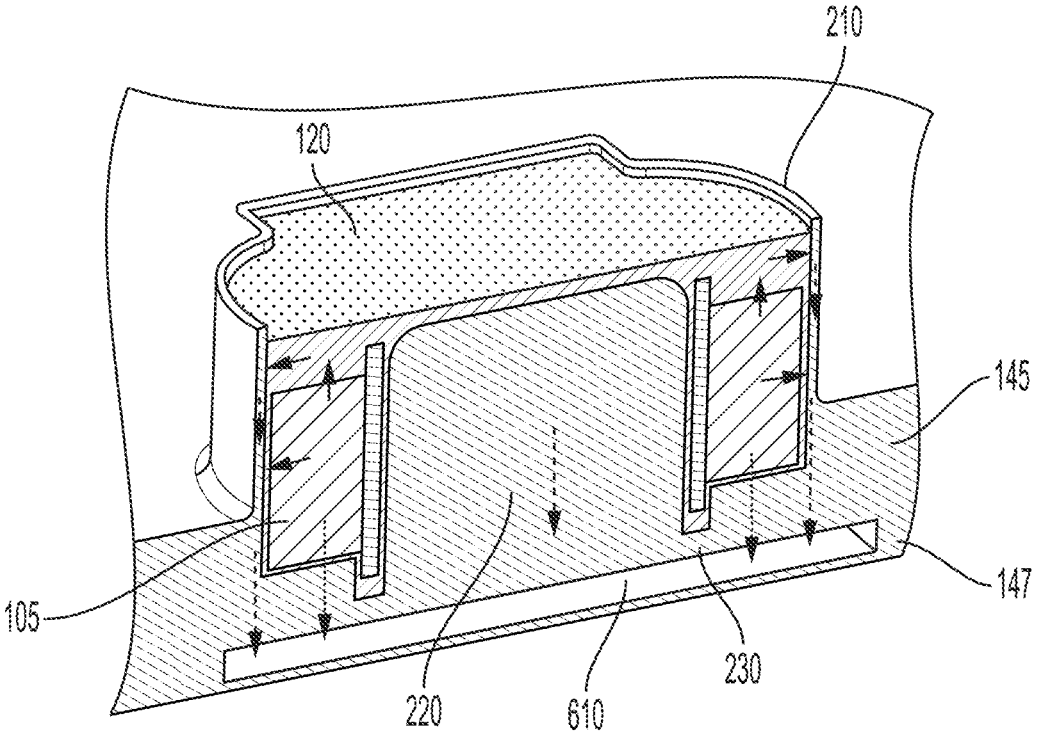
FIG. 9 shows heat from the cavity to the coolant according to one or more embodiments.

FIG. 9 shows heat from the cavity 140 to the coolant 170 according to one or more embodiments. The cross-sectional view along A-A as shown in FIG. 6 is shown in FIG. 9. Thus, the flow channel 610 between the first side 137 and second side 147 is visible. As the arrows indicate, heat flows from the inductor 110 through encapsulant 120 to the outer wall 210 and center plate 220 of the cavity 140 and this heat is conducted through the base 230 of the cavity 140 to the coolant 170 flowing through the flow channel 610.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A cold plate comprising:

a first side with a first surface;

a second side, opposite the first side, with a second surface opposite the first surface;

a flow channel formed between the first side and the second side; and a cavity integrally machined into the first surface of the first side, wherein the cavity is configured to seat an inductor and is defined by an outer wall and a base with thicker sections and thinner sections such that even the thicker sections of the base are thinner than a thickness of the first surface.

2. The cold plate according to claim 1, further comprising an inlet configured to channel coolant into the flow channel.

3. The cold plate according to claim 2, further comprising an outlet configured to channel the coolant out of the flow channel.

4. The cold plate according to claim 1, wherein a thickness of the first side is greater than a thickness of the second side.

5. The cold plate according to claim 1, wherein the cavity includes first portions, second portions, and a center plate.

6. The cold plate according to claim 5, wherein the first portions have the base with the thicker sections and each of the thicker sections is configured to support a core of the inductor.

7. The cold plate according to claim 6, wherein the outer wall corresponding with each of the first portions is curved.

8. The cold plate according to claim 7, wherein the first portions are on opposite ends of the center plate such that the outer wall corresponding with each of the first portions is perpendicular to the center plate.

9. The cold plate according to claim 5, wherein the second portions have the base with the thinner sections and each of the thinner sections is configured to support windings of the inductor.

10. The cold plate according to claim 9, wherein the outer wall corresponding with each of the second portions is straight.

11. The cold plate according to claim 10, wherein the second portions are on opposite sides of the center plate such that the outer wall corresponding with each of the second portions is parallel with the center plate.

12. The cold plate according to claim 1, further comprising one or more additional ones of the cavity configured to seat one or more additional ones of the inductor.

13. The cold plate according to claim 12, wherein the outer wall of at least one of the one or more additional ones of the cavity is part of the outer wall of the cavity.

14. A method of fabricating a cold plate, the method comprising:

machining a flow channel between a first side with a first surface and a second side, opposite the first side, with a second surface opposite the first surface; and machining a cavity into the first surface of the first side, wherein the cavity is configured to seat an inductor and the machining the cavity includes defining the cavity with an outer wall and a base with thicker sections and thinner sections such that even the thicker sections of the base are thinner than a thickness of the first surface.

15. The method according to claim 14, further comprising forming an inlet configured to channel coolant into the flow channel, forming an outlet configured to channel the coolant out of the flow channel, and positioning the flow channel such that a thickness of the first side is greater than a thickness of the second side.

16. The method according to claim 14, wherein the machining the cavity includes machining first portions, second portions, and a center plate.

17. The method according to claim 16, wherein the machining the first portions includes forming the first portions with the base with the thicker sections, each of the thicker sections being configured to support a core of the inductor, and the machining the second portions includes forming the second portions with the base with the thinner sections, each of the thinner sections being configured to support windings of the inductor.

18. The method according to claim 16, further comprising machining the outer wall of each of the first portions to be curved and machining the outer wall of each of the second portions to be straight.

19. The method according to claim 18, wherein the machining the cavity includes machining the first portions to be on opposite ends of the center plate such that the outer wall of each of the first portions is perpendicular to the center plate, and machining the second portions to be on opposite sides of the center plate such that the outer wall of each of the second portions is parallel to the center plate.

20. The method according to claim 14, further comprising machining one or more additional ones of the cavity to seat one or more additional ones of the inductor, wherein the machining includes the outer wall of at least one of the one or more additional ones of the cavity being part of the outer wall of the cavity.

* * * * *